US011857054B2

(12) United States Patent
Skrepetos

(10) Patent No.: US 11,857,054 B2
(45) Date of Patent: Jan. 2, 2024

(54) CUTTING COMB

(71) Applicant: ATHROA HAIR CARE, Moschato (GR)

(72) Inventor: Panagiotis Skrepetos, Athens (GR)

(73) Assignee: ATHROA HAIR CARE, Moshato (GR)

( * ) Notice: Subject to any disclaimer, the term of this patent is extended or adjusted under 35 U.S.C. 154(b) by 0 days.

(21) Appl. No.: 17/869,304

(22) Filed: Jul. 20, 2022

(65) Prior Publication Data

US 2022/0408896 A1 Dec. 29, 2022

Related U.S. Application Data

(63) Continuation of application No. PCT/GR2021/000004, filed on Jan. 19, 2021.

(30) Foreign Application Priority Data

Jan. 22, 2020 (GR) ..... 20200100028

(51) Int. Cl.
*A45D 24/36* (2006.01)
*A45D 24/00* (2006.01)

(52) U.S. Cl.
CPC ..... *A45D 24/36* (2013.01); *A45D 24/007* (2013.01)

(58) Field of Classification Search
CPC ..... A45D 24/10; A45D 24/36; A45D 24/32
See application file for complete search history.

(56) References Cited

U.S. PATENT DOCUMENTS 3,046,654 A 7/1962 Letchfield et al.
4,131,995 A * 1/1979 Pires ..... B26B 19/20 30/200

(Continued)

FOREIGN PATENT DOCUMENTS

CN 103584454 A 2/2014
CN 108081323 A 5/2018

(Continued)

OTHER PUBLICATIONS

International Preliminary Report on Patentability for International Application No. PCT/GR2021/000004, dated Aug. 4, 2022.

(Continued)

*Primary Examiner* — Rachel R Steitz
*Assistant Examiner* — Brianne E Kalach
(74) *Attorney, Agent, or Firm* — Jason H. Vick; Sheridan Ross, PC

(57) ABSTRACT

A split end removal comb. This comb includes an outer shell which houses an inner shell of similar shape but smaller dimensions, and a handle, which houses an electromechanical assembly. The inner comb can slide to a lock position inside the upper part of the outer comb, whereby the hair can be stretched away from the scalp and bent into divided strands. In this position, the blades mounted on the teeth of the inner comb, which can be powered by a motor, can be activated through a shaft running through the perpendicular axis of the device thereby trimming the tips of the hair, as it is being combed by the user. During operation, the hair goes through channels created by the multi-planar arrays of a plurality of teeth, ridges, and blades arranged along various angles and distances. This results in a safe and easy trimming of split ends.

16 Claims, 9 Drawing Sheets

(56) References Cited

U.S. PATENT DOCUMENTS

Figure 1:
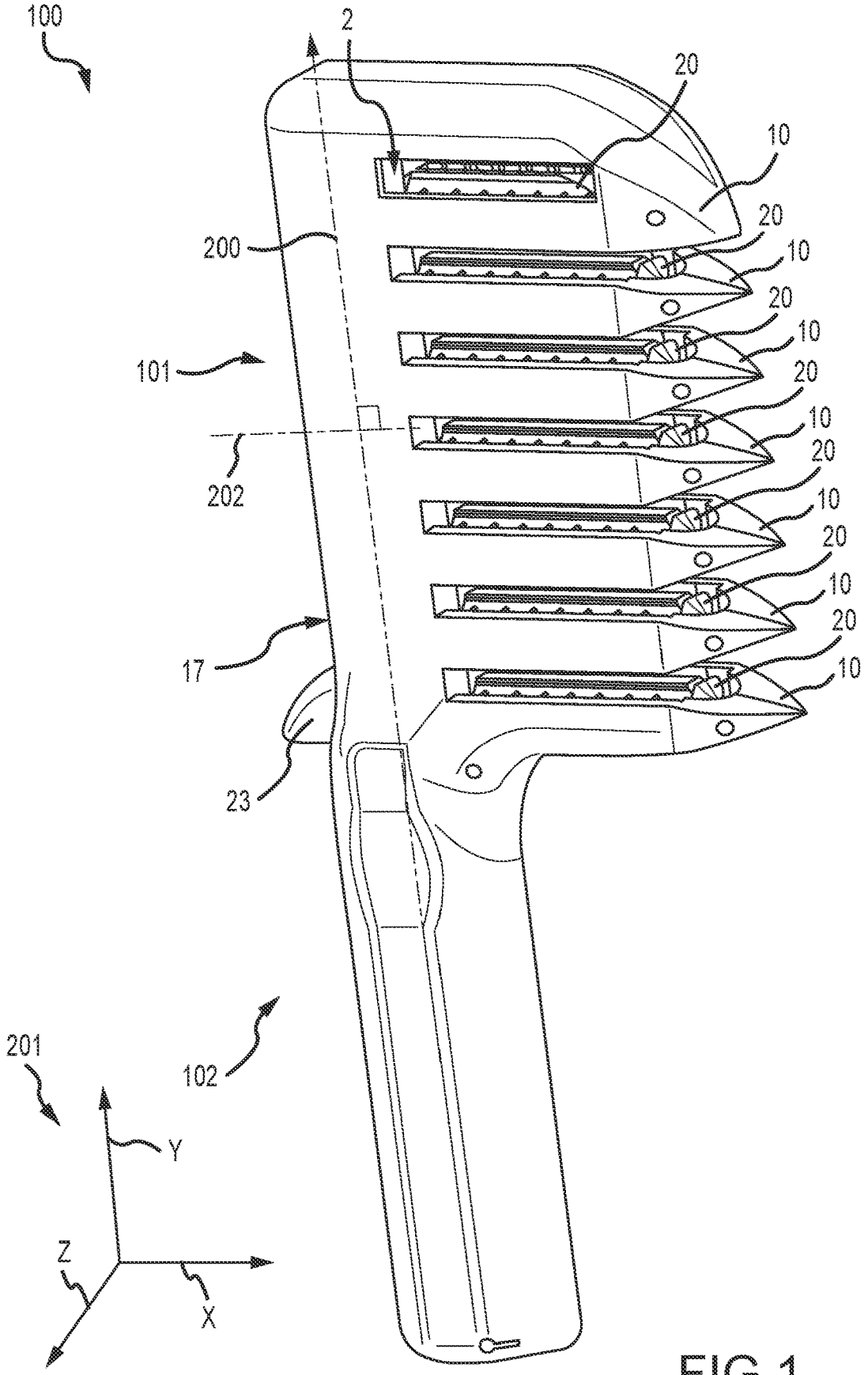

| | | | | |
|---|---|---|---|---|
| 4,841,634 | A | 6/1989 | Cho | |
| 2004/0045168 | A1* | 3/2004 | Talavera | B26B 19/3813 30/30 |
| 2008/0110471 | A1* | 5/2008 | Oliver | A45D 24/02 15/207.2 |
| 2009/0139093 | A1 | 6/2009 | Moreschini | |
| 2018/0065261 | A1* | 3/2018 | Fingold | B26B 21/14 |

FOREIGN PATENT DOCUMENTS

| | | | |
|---|---|---|---|
| CN | 110522155 | A | 12/2019 |
| DE | 8715452 | U1 | 1/1988 |
| GR | 1007167 | B | 1/2011 |
| GR | WO 2015155553 | * | 10/2015 |
| GR | 20140100193 | A | 12/2015 |
| WO | WO 92/10958 | A1 | 7/1992 |
| WO | WO 9706711 | * | 2/1997 |
| WO | WO 2015/155553 | A1 | 10/2015 |

OTHER PUBLICATIONS

International Search Report and Written Opinion for corresponding International Application No. PCT/GR2015/000017 dated Jul. 9, 2015.

Search Report for Corresponding Greek Patent Application No. 20140100193, dated Mar. 17, 2015.

International Search Report for International Application No. PCT/GR2021/000004, dated Jun. 11, 2021.

Written Opinion for International Application No. PCT/GR2021/000004, dated Jun. 11, 2021.

Search Report for Corresponding Greek Patent Application No. 20200100028, dated Aug. 4, 2020.

Intention to Grant for corresponding European Patent Application No. 21707361.8, dated Jun. 12, 2023.

* cited by examiner

CUTTING COMB

CROSS-REFERENCE TO RELATED APPLICATIONS

This application is a Continuation of International Application No. PCT/GR2021/000004, filed on 19 Jan. 2021, which International Application claims the benefit of Greek Patent Application No. 20200100028, filed 22 Jan. 2020, each of which are incorporated herein by reference in their entirety.

The present invention refers to a cutting comb configured to cut or trim the tips of the hair of a person and more specifically, to cut split ends of the hair.

Hair cutting machines are widely used for cutting hair. So far, there have been invented many kinds of devices which can cut the hair at a certain length set by the user, yet, lack the ability of trimming hair of shorter length than that specified by the user with the hair probably being damaged, thereby creating so-called split ends.

A device that aims at hair tip trimming and more specifically at cutting hair split ends is known from WO 2015/155553 A1.

It is an object underlying the present invention to further improve this device in view of its construction and efficiency.

This object is achieved by the combination of features of the independent claim.

According to the present invention, there is provided a cutting comb for cutting split ends of hair that comprises a first comb body with at least two first teeth, a second comb body with at least one second tooth and cutting means for cutting split ends of hair. Furthermore, the first comb body and the second comb body are arranged to be movable relative to each other in a direction parallel to a longitudinal axis of the cutting comb. In addition, at least one first tooth of the first comb body comprises at least one first hair-dividing element for dividing hair into hair strands, wherein the at least one first hair-dividing element is immovably fixed to the at least one first tooth. Alternatively or in addition thereto, the at least one second tooth of the second comb body comprises at least one second hair-dividing element for dividing hair into hair strands, wherein the at least one second hair-dividing element is immovably fixed to the at least one second tooth.

In other words, the cutting comb may advantageously comprise one or more hair-dividing elements which may be immovably fixed a) to one first tooth or the at least two first teeth, b) the at least one second tooth or c) to the first tooth/at least first two teeth and the at least one second tooth.

In other words, the cutting comb may advantageously comprise at least one hair-dividing element which is immovably fixed to a first tooth of the at least two first teeth of the first comb body or to the at least one second tooth of the second comb body, or the cutting comb may comprise at least one hair-dividing element which is immovably fixed to a first tooth of the at least two first teeth of the first comb body and at least one-hair dividing element which is immovably fixed to the at least one second tooth of the second comb body. In the framework of the present invention, a hair-dividing element immovably fixed to a first tooth of the first comb body can be described as a first hair-dividing element. Further, a hair-dividing element immovably fixed to a second tooth of the second comb body can be described as a second hair-dividing element.

The provision of the at least one first hair-dividing element and/or the at least one second-hair dividing element enables, as the name reveals, hair to be divided into hair strands. By that, an accumulation of many hairs in the form of a single hair strand between the at least two first teeth as well as a potential tangling of the hairs that would otherwise prevent them from correctly reaching the cutting means in order to be cut can be avoided. Furthermore, the fact that the at least one first hair-dividing element is immovably fixed to the at least one first tooth and/or that the at least one second hair dividing element is immovably fixed to the at least one second tooth accounts for a simple construction of the cutting comb for achieving a separation of hair into hair strands. In addition, the at least one first hair-dividing element and/or the at least one second hair-dividing element is/are, as being non-moving part(s), more durable, as a non-moving part is in general less prone to failure compared to a moving part. Furthermore, the fixed first hair-dividing element and/or the fixed second hair-dividing element result in a more efficient separation of hair into hair strands. Here, the at least one first hair-dividing element and the at least one second hair-dividing element advantageously serve as guiding elements for the hair strands. The provision of at least one second hair-dividing element in addition to at least one first hair-dividing element results in a better guiding and dividing of hair into hair strands.

By the relative movement of the first comb body and the second comb body to each other, hair entering the space between the at least two first teeth can be brought to such a position, that trimming of the hair tips and thus cutting of the hair split ends can be easily effected. More specifically, hair entering the space between the at least two first teeth can be lifted by the movement of the first comb body and the second comb body relative to each other.

In the simplest arrangement of the cutting comb, the cutting comb advantageously comprises two first teeth and one second tooth. In this case, the cutting means is preferably arranged on the first body, more particularly on one of the at least two first teeth.

Preferably, the first comb body comprises at least two first teeth and the second comb body comprises at least two second teeth, wherein at least one first tooth of the first comb body comprises at least one first hair-dividing element for dividing hair into hair strands, the at least one first hair-dividing element being immovably fixed to the at least one first tooth and/or at least one second tooth of the second comb body comprises at least one second hair-dividing element for dividing hair into hair strands, the at least one second hair-dividing element being immovably fixed to the at least second tooth. In this case, the simplest arrangement of the cutting comb advantageously comprises two first teeth and two second teeth.

According to a further aspect of the present invention, the cutting comb preferably comprises one more first tooth than second teeth. In other words, if "n" is the number of the second teeth, the number of the first teeth is preferably "n+1".

According to an alternative preferred embodiment, the number of the first teeth and the number of the second teeth are the same. In other words, if "n" is the number of the second teeth, the number of the first teeth is preferably also "n".

In a first state of the cutting comb, the at least one, more particularly each, second tooth is preferably aligned with one first tooth in a direction parallel to the longitudinal axis of the cutting comb. In other words, each second tooth and one of the first teeth are preferably positioned at the same height in a direction parallel to the longitudinal axis of the cutting comb, when the cutting comb is in the first state. In a second state of the cutting comb, the at least one second tooth, more particularly each second tooth, is preferably offset from the corresponding first tooth, with which the corresponding second tooth is aligned in the first state of the cutting comb, in a direction parallel to the longitudinal axis of the cutting comb.

Especially when the cutting comb comprises the same number of first teeth and second teeth, in a first state of the cutting comb, each of the at least two first teeth, more particularly each first tooth, is preferably aligned with one of the at least two second teeth, more particularly with one second tooth, in a direction parallel to the longitudinal axis of the cutting comb, and vice versa. In other words, each first tooth and one second tooth are preferably positioned at the same height in a direction parallel to the longitudinal axis of the cutting comb, when the cutting comb is in the first state. In a second state of the cutting comb, at least one first tooth, more particularly each first tooth, is preferably offset from the corresponding second tooth, with which the corresponding first tooth is aligned in the first state of the cutting comb, in a direction parallel to the longitudinal axis of the cutting comb.

It is noted that the relative movement of the first comb body and the second comb body to each other also means a movement of the first teeth and the at least one second tooth (or at the at least second teeth) with respect to each other.

The second state of the cutting comb is advantageously a state, in which hair between the at least two first teeth, is lifted by the movement of the first comb body and the second comb body relative to each other, more particularly by the movement of the at least one second tooth. Accordingly, the first state of the cutting comb is advantageously a state, in which hair between the at least two first teeth, is substantially on the level of one of the at least two first teeth and/or the at least one second tooth.

In order to bring the cutting comb from the first state to the second state and vice versa, i.e. to move the second comb body relative to the first comb body, a push handle is preferably provided on the second comb body for a manual operation. Alternatively or in addition thereto, a movement of the first and second comb bodies relative to each other can be effected in an automated way by an electric motor. To this end, the user of the cutting comb may push a button or operate a switch.

Furthermore, the at least two first teeth and the at least one second tooth are arranged at an angle to the longitudinal axis of the cutting comb.

It is preferred that the at least two first teeth and/or the at least one second tooth are arranged vertically (at an angle of ninety degrees) to the longitudinal axis of the cutting comb. In other words, a longitudinal axis of the first teeth and/or a longitudinal axis of the second tooth is preferably vertical to the longitudinal axis of the cutting comb.

More specifically, the longitudinal axis of a first tooth is parallel to the longitudinal axis of a second tooth.

Preferably, the first comb body comprises a first base body. The first base body preferably extends in the direction of the longitudinal axis of the cutting comb.

Furthermore, the at least two first teeth extend from the first base body.

Preferably, the second comb body comprises a second base body. The second base body preferably extends in the direction of the longitudinal axis of the cutting comb.

Furthermore, the at least one second tooth extends from the second base body.

The cutting comb preferably comprises a head and a handle. More specifically, the head comprises a head portion of the first comb body and a head portion of the second comb body. The head portion of the first comb body and the second comb body comprises in particular the at least two first teeth and the at least one second tooth, respectively. Further, the handle comprises in particular a handle portion of the first comb body and a handle portion of the second comb body.

The cutting means preferably comprise a single (cutting) blade or knife. Alternatively, the cutting means may comprise a plurality of (cutting) blades or knifes.

Preferably, the cutting means is arranged between two neighbouring second teeth. More preferably, the cutting means is provided on a side of a second tooth facing a side of a neighbouring second tooth. Advantageously, the cutting means is provided on a whole side of the second tooth. In other words, the cutting means extends over the whole length of the second tooth.

Preferably, the second comb body is arranged in a movable manner inside the first comb body. To this end, the first comb body is advantageously formed as a hollow body and comprises an inner space.

In other words, preferably, the first comb body is an outer comb body and the second comb body is an inner comb body.

In this context, at least one of the at least two first teeth, preferably the at least two first teeth, is/are hollow in order to accommodate a second tooth.

In the framework of the present application, the term "cutting comb" means a cutting device that has the form/shape of a comb. Due its familiar shape, the cutting comb can be easily used by any person by moving the cutting comb along the hair in a way a comb without cutting means would be used.

Furthermore, the first teeth of the first comb body and the second teeth of the second comb body can also be described as first comb teeth and second comb teeth, respectively, within the framework of the present application.

It is noted that, in the framework of the present invention, the expression "immovably fixed" in connection with the at least one first hair-dividing element and the second hair-dividing element is equivalent to the expressions "fixed in a non-moving manner" or "not movably fixed" and means that these elements are not movable with respect to the at least one first tooth and the at least one second tooth, respectively.

The at least one hair-dividing element and/or the at least one second hair-dividing element are preferably integrated with the at least one first tooth and the at least one second tooth, respectively.

In other words, the at least one hair-dividing element is preferably made in one piece with the at least one first tooth and/or the at least one second hair-dividing element is preferably made in one piece with the at least one second tooth.

Preferably, the at least one first tooth comprises at least two first hair-dividing elements, which form a first channel, and/or the at least one second tooth comprises at least two second hair-dividing elements, which form a second channel, so that hair is guided through the first channel and/or the second channel.

The first channel and the second channel can be aligned or overlap with each other.

Advantageously, the at least one first hair-dividing element is formed as a first projection and/or the at least one second hair-dividing element is formed as a second projection.

Preferably, the first projection and/or the second projection is/are formed as a rib or a ridge.

More advantageously, all first hair-dividing elements and/or all second hair-dividing elements are each formed as a projection (first projections and second projections, respectively).

Alternatively, the at least one first hair-dividing element and/or the at least one second hair-dividing element can each be formed as a recess in the at least one first tooth and/or the at least one second tooth, respectively. Preferably, all first hair-dividing elements and/or all second hair-dividing elements are each formed as a recess (first recesses and second recesses, respectively).

However, any combination of projections and recesses for the first hair-dividing elements and/or the second hair-dividing elements is possible.

Advantageously, the first projection extends vertically from the at least one first tooth and/or the second projection extends vertically from the at least one second tooth. In other words, the first projection extends from the at least one first tooth in a direction vertical to a longitudinal axis of the at least one first tooth and/or the second projection extends from the at least one second tooth in a direction vertical to a longitudinal axis of the at least one second tooth.

Preferably, the at least one first hair-dividing element and/or the at least one second hair-dividing element has/have at least one curved portion. This construction helps to avoid kinks in the hair strands caused by the first hair-dividing element and/or the second hair-dividing element and thus results in a better guiding of the hair.

More preferably, the curved portion is a round portion.

The curved portion is preferably provided at a first end and/or at a second end and/or at a middle part between the first end and the second end of the corresponding hair-dividing element, more particularly the corresponding projection.

Preferably, the at least one first hair-dividing element has a curved portion at a first end and/or a second end of the at least one first hair-dividing element.

Furthermore, the at least one second hair-dividing element has a curved portion at a middle part between a first end and a second end of the at least one second hair-dividing element.

It is further advantageous to arrange the at least one first hair-dividing element and the at least one second hair-dividing element with an offset to each other in a direction in which the at least one first tooth and/or the at least one second head tooth extend. The direction in which the at least one first tooth and/or the at least one second head tooth extend corresponds to the direction of a longitudinal axis of the at least one first tooth and the longitudinal axis of the at least one second tooth, respectively. By doing so, hair can be separated into more hair strands without the need of increasing the number of the hair-dividing elements in the cutting comb.

According to another advantageous aspect of the present invention, at least one first tooth and/or at least one second tooth are heatable. This has the effect of shaping and softening the hair, thereby making cutting of the hair tips easier.

To this end, the at least one first tooth and/or the at least one second tooth can preferably be provided with a heating element, more preferably with an electric resistance.

Further, at least one first tooth and/or at least one second tooth are advantageously made out of a material that in combination with the hair does not cause static electricity in the hair, for example when the hair comes in contact with or is near to the at least one first tooth and/or the at least one second tooth. By preventing the creation of static electricity, i.e. the ionization of the hairs, the hairs are allowed to move towards the cutting means without experiencing additional electrostatic forces that would make them untamed or fly away.

In a preferred embodiment of the present invention, at least one second tooth comprises the cutting means.

The cutting means preferably comprises at least one cutting blade, wherein an angle between the at least one cutting blade and a longitudinal axis of the at least one second tooth is lower than ninety degrees and greater than zero degrees, more preferably between seventy degrees (inclusive) and twenty degrees (inclusive), most preferably equal to 45 degrees.

In other words, the cutting means preferably comprise at least one cutting blade, wherein an angle between the at least one cutting blade and a longitudinal axis of the cutting comb is lower than ninety degrees and greater than zero degrees, more preferably between seventy degrees (inclusive) and twenty degrees (inclusive), most preferably equal to 45 degrees.

The angle of the cutting means is preferably adjustable. Thus, the angle can be adjusted to the needs of the user. In this way, the length of the cut can be changed within a certain range. The prior adjustment of the angle of the cutting means provides the best possible results for each hair type, since the behaviour of the hair differs from one person to another due to their inherent differences in hair thickness, strength, straightness or not, greasiness, age. These differences cause the hair to bend differently and consequently reach the cutting means at a different angle. Therefore, the possibility of adjusting the angle of the cutting means is advantageous, as this angle can be chosen in accordance to the bending of the hair of a person in order to effect a better trimming of the hair.

The cutting means preferably comprises two cutting blades that are symmetrical with respect to a plane comprising the longitudinal axis of the cutting comb and the longitudinal axis of the second teeth (a plane parallel to the XY-plane). Due to this, the cutting comb 1 can be used from both left-handed and right-handed users without any further adjustment.

In a preferred embodiment of the present invention, the cutting means is heatable. Heating of the cutting means causes heating of the hair and more specifically of the hair tips, thereby making them softer and more pliable. In this way, trimming of the hair tips can take place more easily.

In order to achieve that, an electrical resistance or a plurality of electrical resistances is arranged in the cutting comb in such a way, that the cutting means can be heated.

More specifically, the electrical resistance(s) can preferably be arranged to be in contact with a body of the at least one blade or knife. The body of the at least one blade or knife is attached to the cutting portion of the blade or knife (the portion that comes in contact with the hair) in an electrically insulated manner.

In a preferred embodiment of the present invention, the cutting comb comprises a plurality of first teeth and/or a plurality of second teeth.

It is preferred that all first teeth except for one first tooth of the plurality of first teeth each comprise a first hair-dividing means. Alternatively or in addition thereto, all second teeth except for one second tooth of the plurality of second teeth each comprise a second hair-dividing means.

Furthermore, the cutting comb preferably comprises a plurality of cuttings means.

The advantage of the cutting comb comprising a plurality of first teeth and/or a plurality of second teeth and/or cutting means is that the tips of many hair strands can be trimmed at the same time, especially with a single movement of the cutting comb through the hair.

More preferably, all second teeth except for one second tooth of the plurality of second teeth each comprise a cutting means. In other words, the cutting comb preferably has one less cutting means than second teeth.

In a preferred embodiment of the present invention, a second tooth of the plurality of second teeth comprises cutting means and no second hair-dividing elements, while another second tooth of the plurality of second teeth comprises at least one second hair-dividing element and no cutting means. In this embodiment, it is also preferred that the first tooth that has no first hair-dividing element is aligned with the second tooth that comprises no cutting means in the first state of the cutting comb.

The cutting comb preferably comprises the same number of first teeth and second teeth.

A distance between two neighbouring first teeth in the direction of the longitudinal axis of the cutting comb is preferably the same for all the first teeth.

Furthermore, a distance between two neighbouring second teeth in the direction of the longitudinal axis of the cutting comb is preferably the same for all the second teeth.

More preferably, the second tooth that has no cutting means is the closest second tooth to a handle of the cutting comb. The second tooth that has no second hair-dividing means is preferably the farthest second tooth from a handle of the cutting comb.

Preferably, the cutting comb comprises means being configured to create a pressure in an inner space of the first comb body that is lower than the atmospheric pressure (sub-atmospheric pressure), so that hair is sucked towards the cutting means. By doing so, the cutting of the hair tips is made easier and the efficiency of the cutting comb is thus further improved.

More preferably, the means for creating a pressure in the inner space of the first comb body that is lower than the atmospheric pressure is a fan. The fan can preferably be operated by an electric motor. The rotation of the fan being arranged on the axis of the electric motor creates conditions of lower pressure in the inner space of the first comb body than the atmospheric pressure, so that the tips of hair are sucked towards the cutting means.

Advantageously, the fan and/or the electric motor can be provided in a handle of the cutting comb.

The first comb body is preferably formed by two parts, especially two symmetrical parts, being joined together. This simplifies the assembly procedure of the cutting comb.

For the sake of conciseness, it is noted that the aspects described above with regard to the at least one first hair-dividing element and/or the at least one second hair-dividing element apply to each first hair-dividing element and/or each second hair-dividing element, if the cutting comb comprises at least two or more first and/or second hair-dividing elements.

At least one second tooth, preferably comprises, in particular all second teeth each preferably comprise, a hair-bending element for bending the hair that is placeable between two neighbouring first teeth.

The hair-bending element preferably extends over 50%, more preferably over 70%, more preferably over 90%, even more preferably over 100%, of the second tooth, in the direction of the longitudinal axis of the second tooth.

The hair-bending element is preferably formed as a projection projecting from a top surface of the second tooth.

The projection preferably has a cross-section in the form of a triangle. The cross-section is preferably defined in a plane vertical to the longitudinal axis of the at least one second tooth. The cross-section is preferably the same over the whole length of the projection in the direction of the longitudinal axis of the second tooth.

The projection preferably has a height equal to ⅔ of a distance between a lowest point of the cutting means and the top surface of the second tooth. The height is preferably measured from a highest point of the top surface of the second tooth.

More particularly, all second teeth each comprise a hair-bending element for bending the hair that is placeable between two neighbouring first teeth. The hair-bending element of each second tooth may have the features as previously described.

At least one second tooth is preferably hollow. Furthermore, the at least one second tooth that is hollow preferably comprises at least one opening. Through the opening, an inner space of the at least one second tooth communicates in an advantageous manner with the environment (atmosphere).

The inner space of the at least one second tooth that is hollow communicates with the means for creating a sub-atmospheric pressure in the inner space of the first comb body, so that air of the inner space of the at least one second tooth can be drawn/sucked by the means for creating sub-atmospheric pressure in the inner space of the first comb body.

Preferably, the cutting comb comprises a shaft/rod being connected with the cutting means, so that the cutting means are moveable by a movement of the shaft/rod. The shaft/rod is preferably driveable by an electric motor.

Advantageously, a single electric motor can be provided for the shaft/rod and the means for creating a sub-atmospheric pressure.

The shaft/rod can advantageously be hollow, wherein an inner space of the shaft/rod may communicate with the inner space of the at least one second tooth. This may preferably be achieved by at least one opening of the shaft/rod. The inner space of the shaft/rod may communicate with the inner space of the first comb body, preferably by at least one opening of the shaft/rod.

The first comb body preferably comprises an opening through which the inner space of the first comb body communicates with the environment (atmosphere). Through the opening, the air being drawn through the opening in the at least one second tooth into the inner space of the first comb body by the means for creating a sub-atmospheric pressure in the inner space of the first comb body can exit the inner space of the first comb body.

Figure 2:
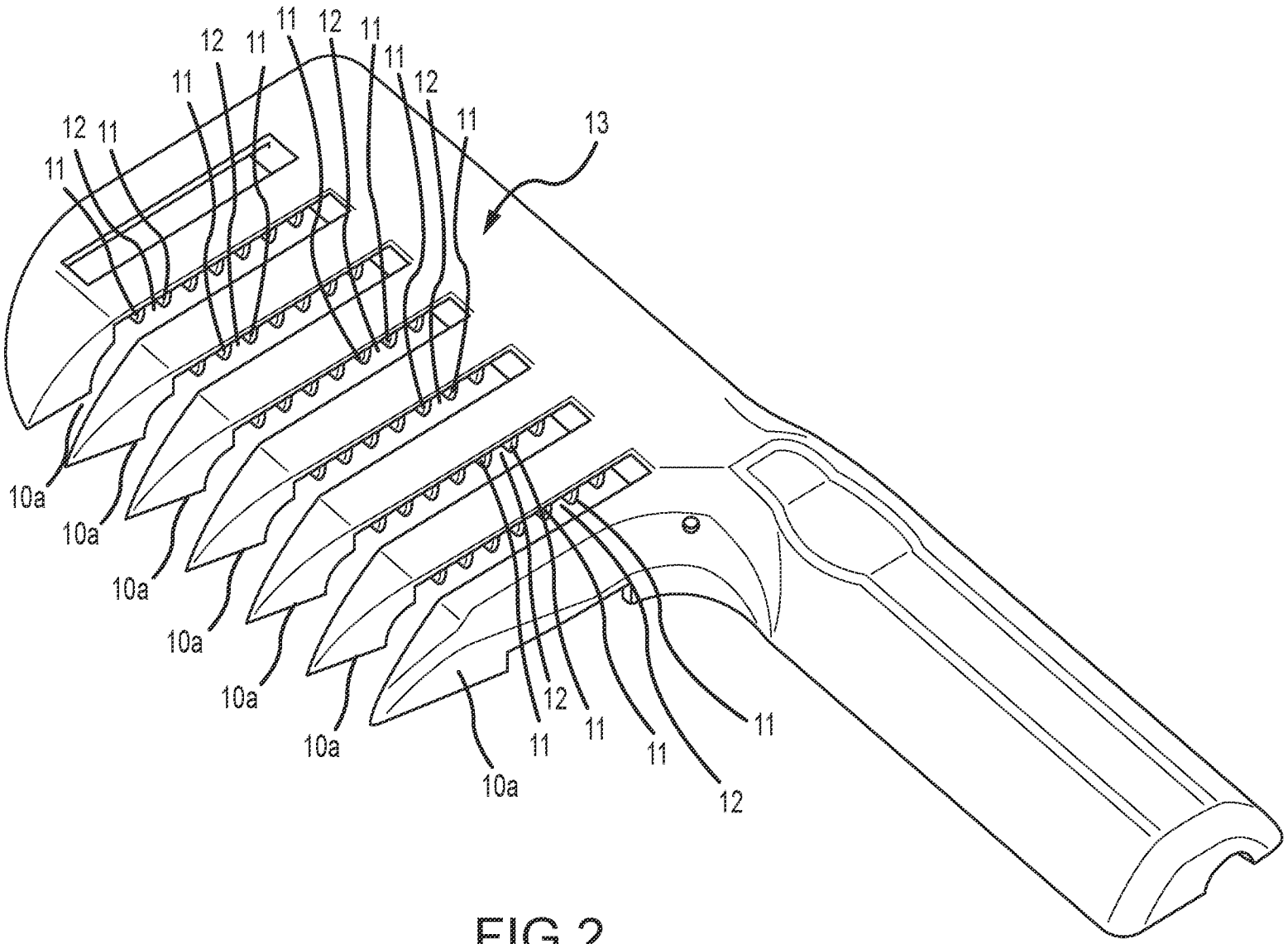
Figure 3:
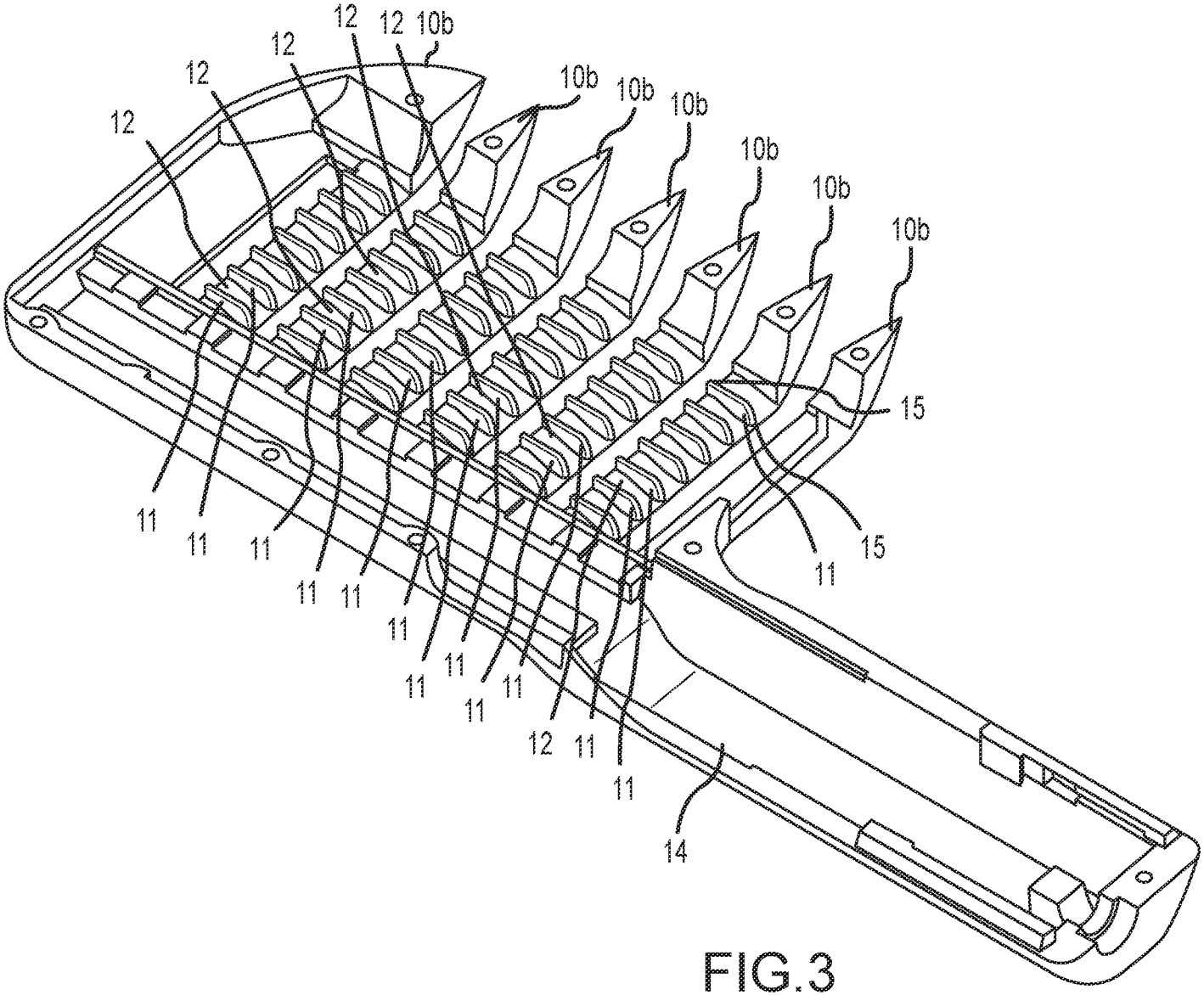
Figure 4:
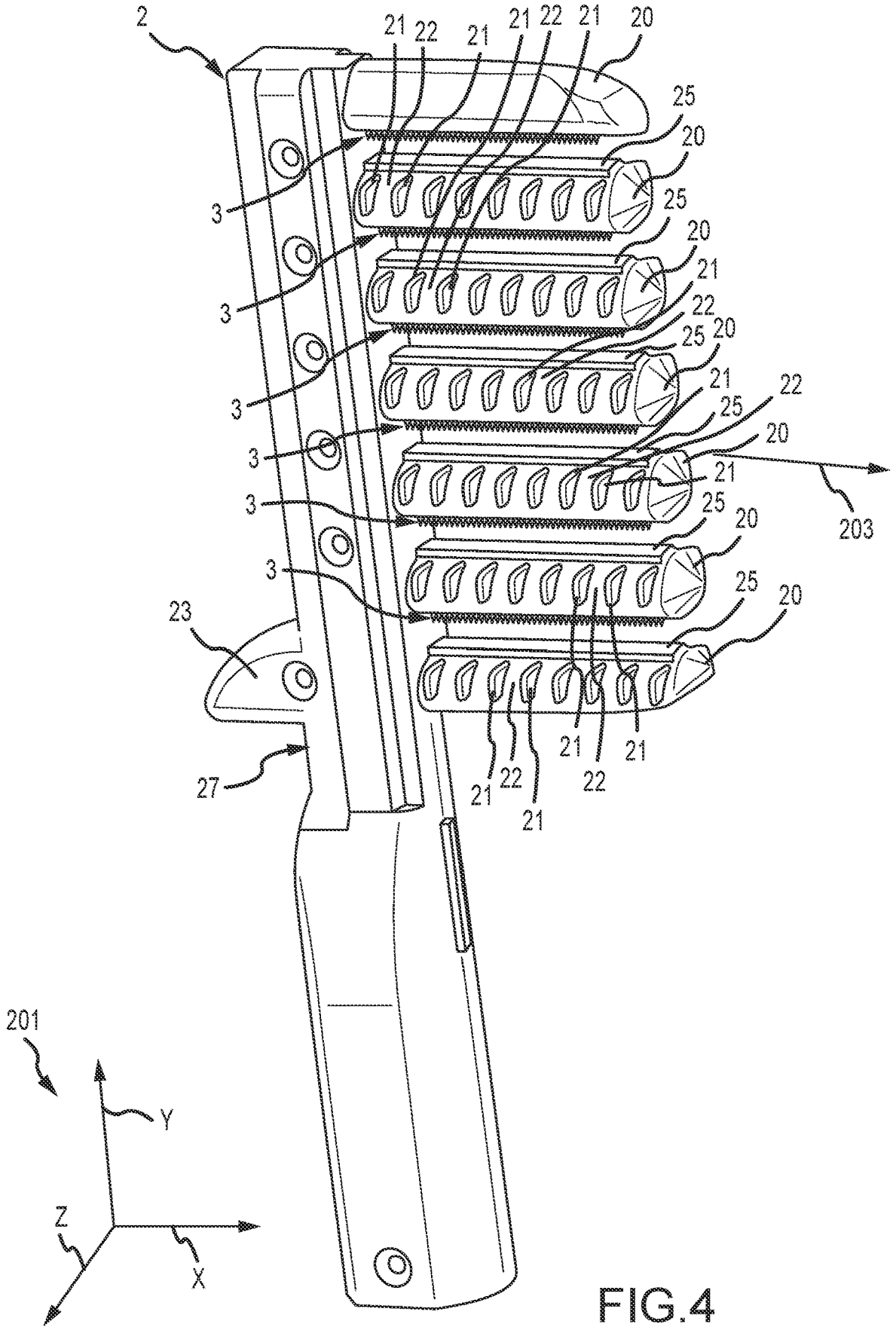
Figure 5:
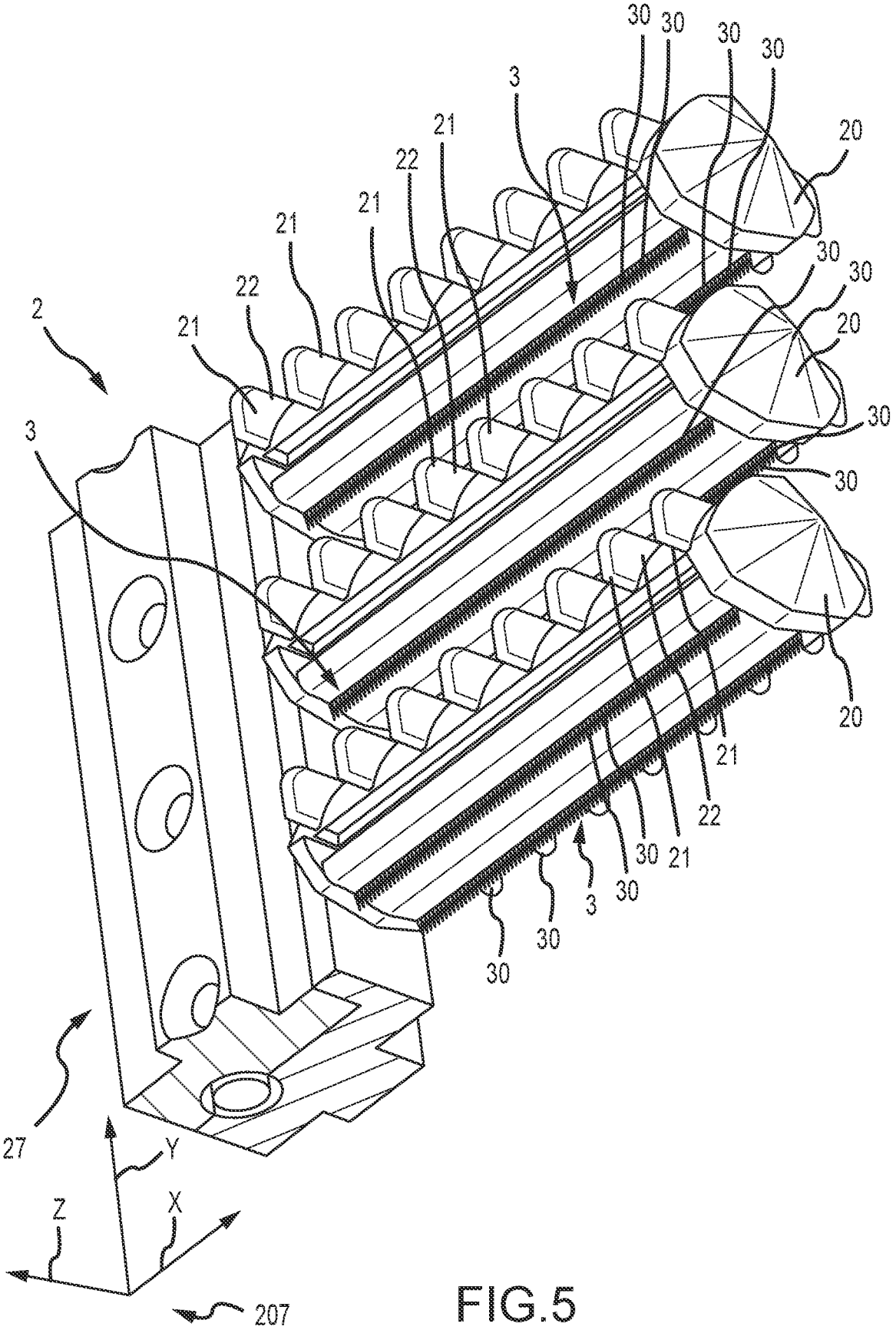
Figure 6:
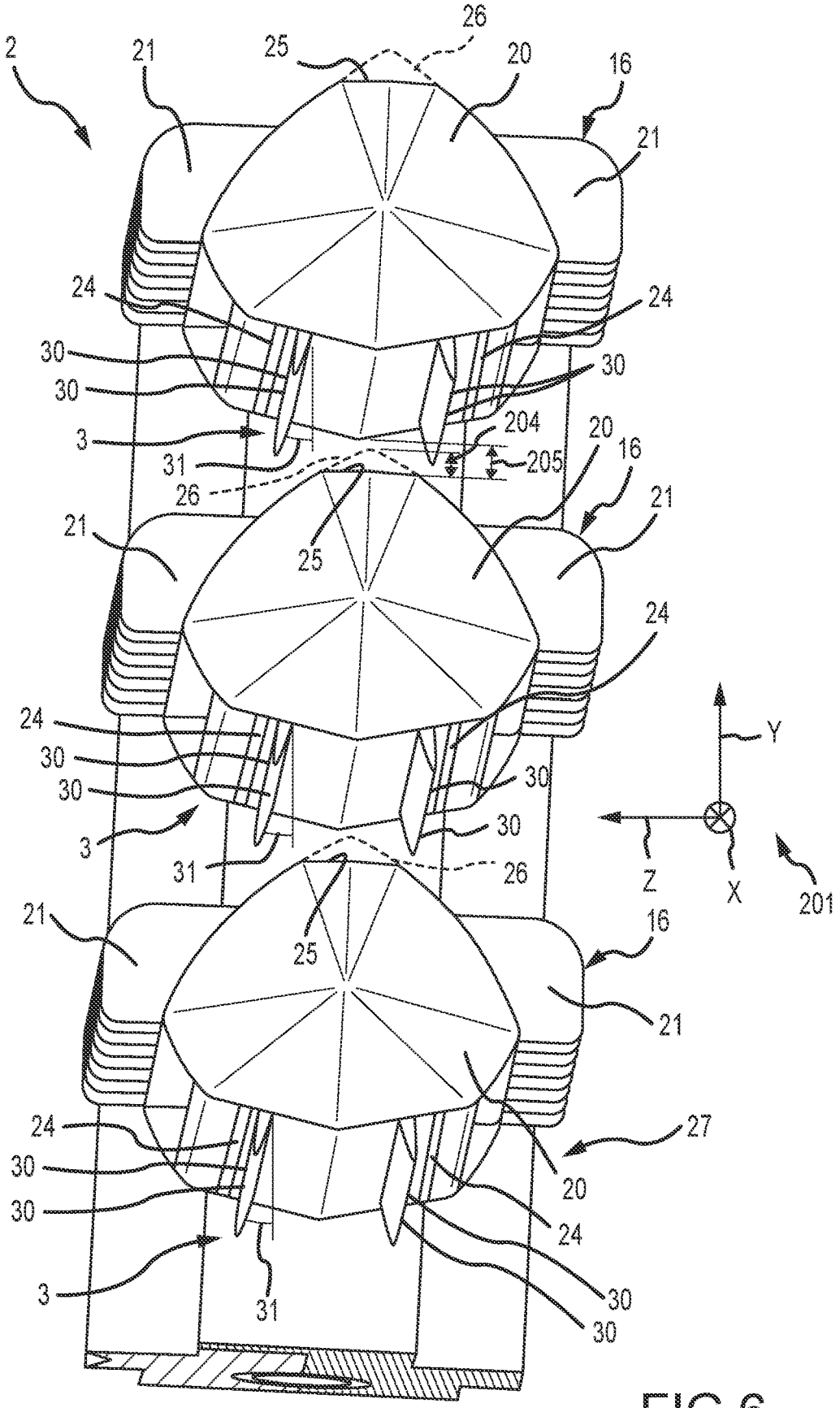
Figure 7:
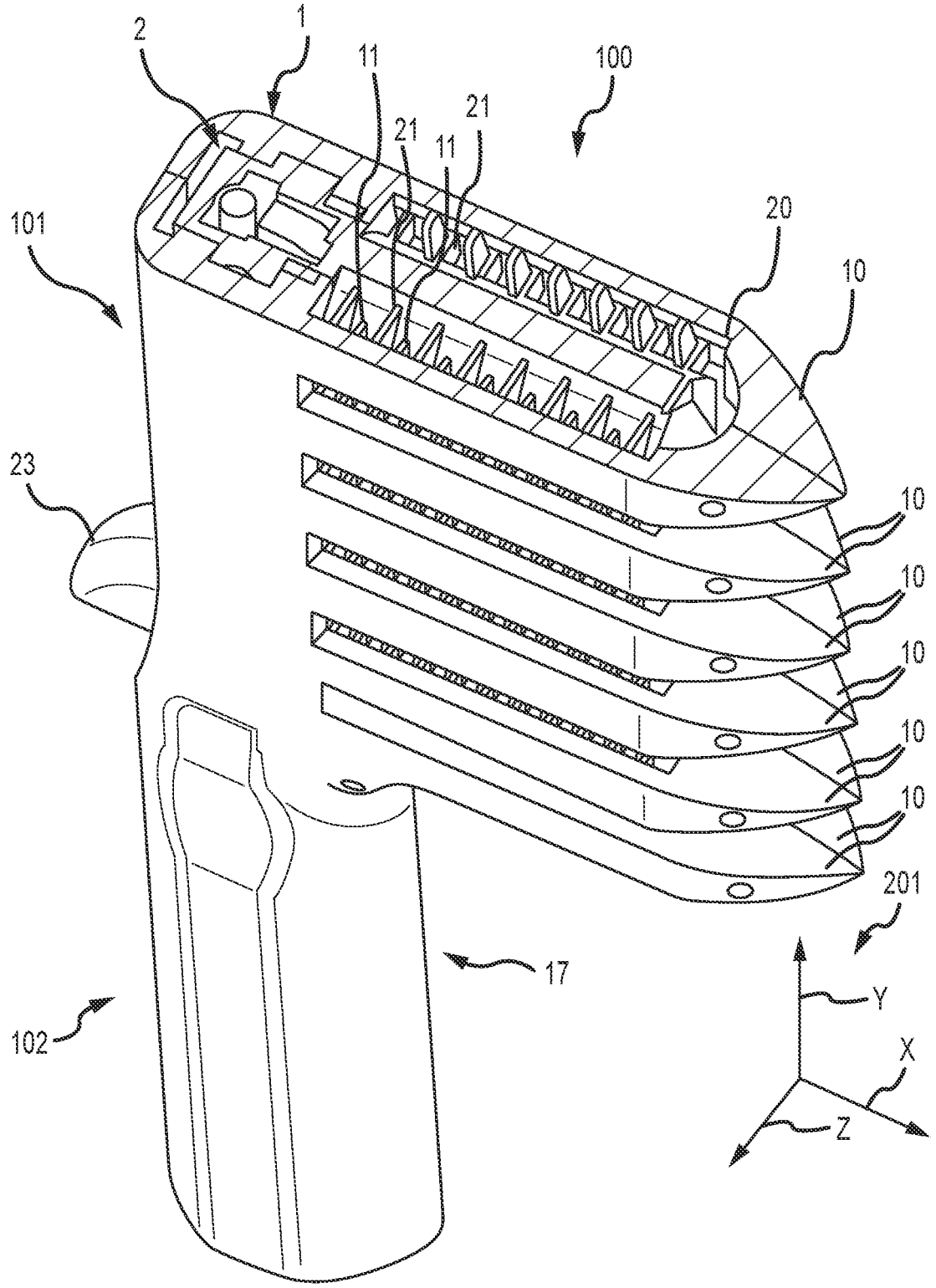
Figure 8:
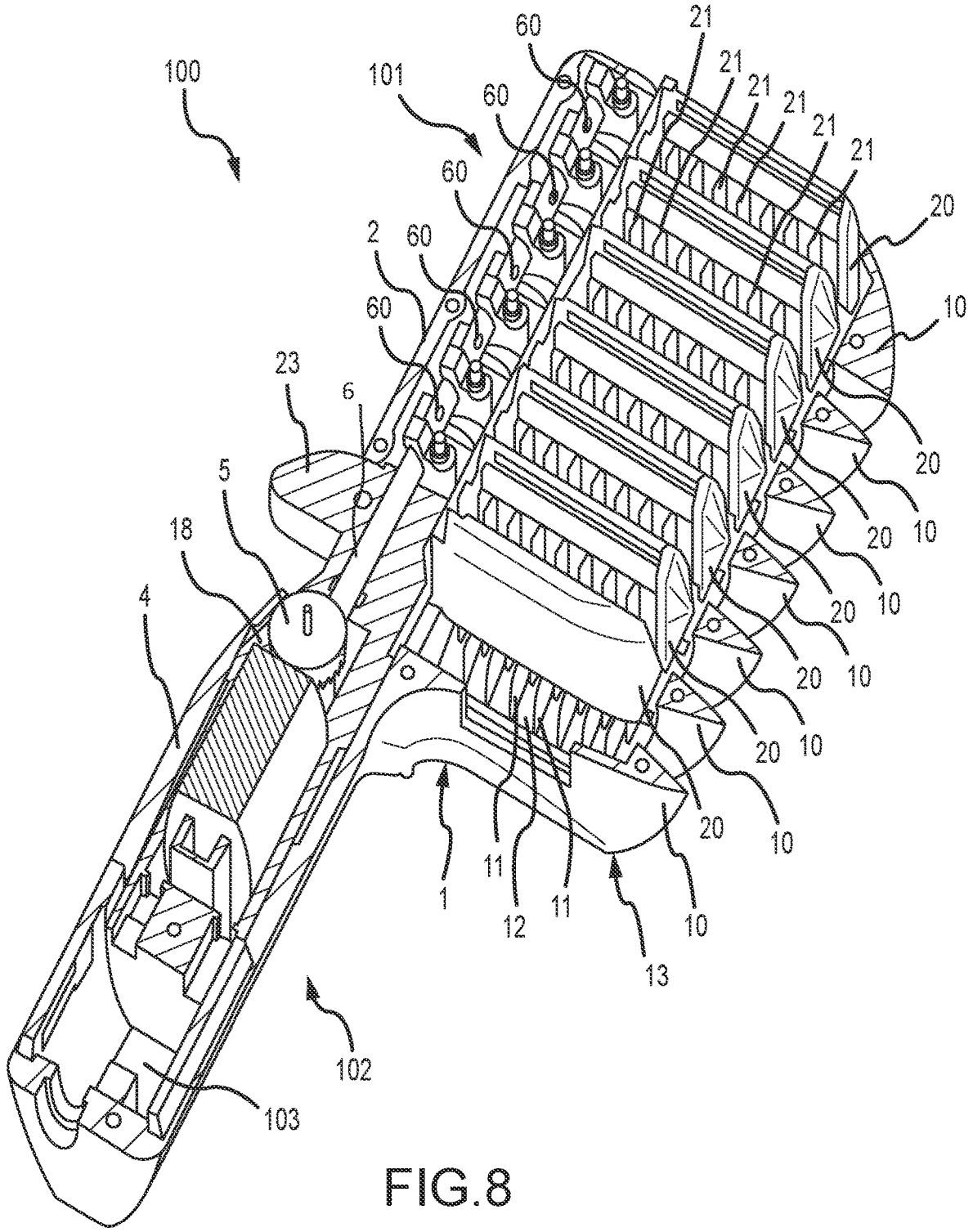
Figure 9:
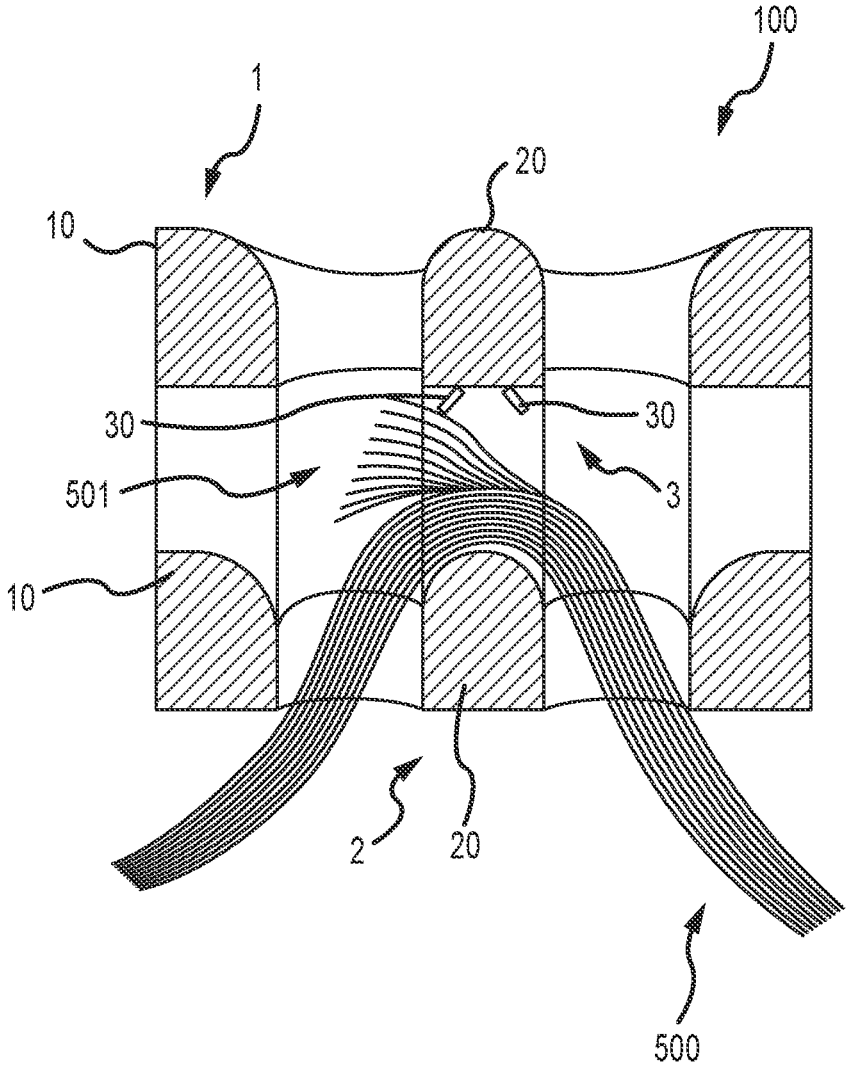

These and further details, advantages and features of the present invention will be described based on a preferred embodiment of the invention and by taking reference to the accompanying figures. It is shown in:

FIG. 1 a schematic perspective view of the cutting comb according to a preferred embodiment of the present invention;

FIG. 2 a schematic perspective view of a part of a first comb body of the cutting comb of FIG. 1;

FIG. 3 a schematic perspective view of a part of the first comb body of the cutting comb of FIG. 1;

FIG. 4 a schematic perspective view of a second comb body of the cutting comb of FIG. 1;

FIG. 5 a schematic perspective view of a part of the second comb body of FIG. 4;

FIG. 6 a schematic perspective view of the part of the second comb body of FIG. 5;

FIG. 7 a schematic perspective view of a part of the cutting comb of FIG. 1 in a first state, FIG. 8 a schematic perspective view of a part of the cutting comb of FIG. 1 in a second state, and FIG. 9 a simplified schematic cross-sectional view of a part of the cutting comb according to the preferred embodiment.

In the following, a cutting comb 100 for trimming the hair tips of a person and thereby cutting potential split ends of the hair according to a preferred embodiment of the present invention will be described in detail based on FIGS. 1 to 8. In FIGS. 1, 4, 5, 6 and 7 a coordinate system 201 has also been drawn in order to enhance the understanding of the structure of the cutting comb 100.

FIG. 1 shows a perspective view of the assembled cutting comb 100.

The cutting comb 100 comprises a first comb body 1 and a second comb body 2, which are configured to be movable relative to each other in a direction parallel to a longitudinal axis 200 of the cutting comb 100.

More specifically, the second comb body 2 is arranged in a movable manner inside the first comb body 1. To this end, the first comb body 1 is formed as a hollow body and comprises an inner space 103 (FIG. 8), in which the second comb body 2 is positioned. Thus, the first comb body 1 and the second comb body 2 can be considered as an outer and an inner comb body, respectively.

As can be seen from FIG. 8, the second comb body 2 is in particular slidably arranged in the first comb body 1 in the direction of the longitudinal axis 200 of the cutting comb 100. It is noted that the longitudinal axis 200 of the cutting comb 100 is parallel to the Y-axis of the coordinate system 201.

For moving the second comb body 2 relative to the first comb body 1, a push handle 23 is provided on the second comb body 2. The user of the cutting comb 100 pushes the push handle 23 in the direction of the Y-axis of the coordinate system 201, i.e. upwards in this case, when holding the cutting comb 100 by a handle 102, thereby causing the second comb body to be moved with respect to the first comb body 1. The exact function of the cutting comb 1 will be explained later in more detail with regard to FIGS. 7 and 8.

Furthermore, the first comb body 1 comprises a plurality of first teeth 10 and the second comb body 2 comprises a plurality of second teeth 20. In particular, the number of first teeth 10 equals the number of second teeth 20.

In the present embodiment, seven first teeth 10 and seven second teeth 20 are provided. Thus, many hairs can be trimmed at the same time, while the cutting comb 100 is still handy for the user. However, the number of the first teeth 10 and the second teeth 20 can vary and also be different from each other.

Due to the hollow shape of the first comb body 1, each of the first teeth 10 is hollow in order to accommodate/enclose a corresponding second tooth 20, as can be seen from FIG. 1.

In addition, the first teeth 10 and the second teeth are arranged at an angle to the longitudinal axis 200 of the cutting comb 100. The first teeth 10 extend from a first base body 17 of the cutting comb 100 and the second teeth 20 from a second base body 27 of the cutting comb 100. Both the first base body 17 and the second base body 27 extend in the direction of the longitudinal axis 200 of the cutting comb 100. It is noted that the first base body 17 and the first teeth 10 correspond to the first comb body 1, while the second base body 27 and the second teeth 20 correspond to the second comb body 2.

More specifically, the first teeth 10 and the second teeth 20 each extend vertically to the longitudinal axis 200 of the cutting comb 100. In other words, a longitudinal axis 202 of the first teeth 10 and a longitudinal axis 203 of the second teeth 20 (shown in FIGS. 1 and 4, respectively) are vertical to the longitudinal axis 200 of the cutting comb 100. The longitudinal axis 202 of the first teeth 10 and the longitudinal axis 203 of the second teeth are parallel to the X-axis of the coordinate system 201. Thus, it is apparent that the first teeth 10 are arranged parallel to each other. The second teeth 20 are also arranged parallel to each other.

The longitudinal axis 202 of the first teeth 10 and the longitudinal axis of the second teeth 20 are parallel to each other, so that also the first teeth 10 and the second teeth 20 are arranged parallel to each other.

Furthermore, it can be derived from FIGS. 2 and 3 that the first comb body 1 is formed by two parts that are joined together. FIG. 2 shows a first part 13 of the first comb body 10 and FIG. 3 a second part 14 of the first comb body 10.

More particularly, the first part 13 and the second part 14 are identical to each other and symmetrical with respect to a plane comprising the longitudinal axis 200 of the cutting comb 100 and the longitudinal axis 202 of the first teeth 10 (a plane parallel to the XY-plane).

Due to this construction of the first comb body 1, each of the first teeth 10 is formed by a first part **10*a* and a second part 10*b*, as depicted in FIGS. 2 and 3**, respectively.

The first teeth 10 are arranged such that a distance between two neighbouring first teeth 10 in the direction of the longitudinal axis 200 of the cutting comb 100 is the same for all the first teeth 10. The same applies to the second teeth 20.

In order to facilitate the trimming of the hair tips, the cutting comb 100 comprises a plurality of first hair-dividing elements 11, which are provided in an immovably fixed manner on first teeth 10 of the first comb body 1. The hair-dividing elements 11 are preferably integrated with the corresponding first teeth 10. All first hair-dividing elements 11 are identical to each other in the present embodiment. However, differently shaped and/or sized first hair-dividing elements 11 can be provided.

Referring to FIGS. 2 and 3, it can be seen that in particular all first teeth 10 except one (i.e. six first teeth 10 in this embodiment) each comprise a plurality of first hair-dividing elements 11. The first tooth 10 of the first comb body 1 that does not have any first hair-dividing elements 11 is the one closest to the handle 102 of the cutting comb 100.

More specifically, each of the first part **10*a* and the second part 10*b* of each of the first teeth 10 of the first comb body 1 comprises a plurality of first hair-dividing elements 11 on its corresponding inner side. This means that the first hair-dividing elements 11 are directed to/face the second teeth 20 of the second comb body 2**.

In other words, each of the first teeth 10 of the first comb body 1 comprises first hair-dividing elements 11 which are arranged on both of its inner sides with respect to a plane comprising the longitudinal axis 200 of the cutting comb 100 and the longitudinal axis 202 of the first teeth 10 (a plane parallel to the XY-plane).

As depicted in FIG. 3, the first hair-dividing elements 11 of the first part **10*b* are equally distanced from each other in the direction of the longitudinal axis of the first teeth 10**.

Between neighbouring first hair-dividing elements 11 first channels 12 are formed. Due to the equal distance between all neighbouring first hair-dividing elements 11 as well as their identical construction, the first channels 12 are also identical to each other.

Advantageously, the first hair-dividing elements 11 are formed as first projections. The first projections are more specifically formed as ribs or ridges. Each of the first projections extends vertically from the corresponding first tooth 10.

The first hair-dividing elements 11 preferably extend over a whole thickness of the corresponding second part 10*b* of the first tooth 10. The thickness is measured in a direction parallel to the longitudinal axis 200 of the cutting comb 100. Furthermore, the first hair-dividing elements 12 extend over a whole length of the corresponding second part 10*b* of the corresponding first tooth 10.

Moreover, the first hair-dividing elements 11 each comprise at least one curved portion. This construction contributes to a better guiding of the hair.

In the present embodiment, two curved portions 15 are preferably provided at a first end and at a second end of the corresponding hair-dividing element 11 (FIG. 3). The middle part connecting the first end and the second end is preferably straight.

Advantageously, the first hair-dividing elements 11 of the first part 10*a* are arranged and formed in the same manner as the first hair-dividing elements 11 on the second part 10*b*.

Referring now to FIG. 4, a perspective view of the second comb body 2 is shown.

Similar to the first comb body 1, the second comb 2 comprises a plurality of second hair-dividing elements 21, which are provided in an immovably fixed manner on second teeth 20 of the second comb body 2. The second hair-dividing elements 21 are preferably integrated with the corresponding second teeth 20. All second hair-dividing elements 21 are identical to each other in the present embodiment. However, differently shaped and/or sized second hair-dividing elements 21 can be provided.

In particular, all second teeth 20 except one (i.e. six second teeth 20 in this embodiment) each comprise a plurality of second hair-dividing elements 21. The second tooth 20 of the second comb body 2 without any second hair-dividing elements is the one located the farthest away from the handle 102 of the cutting comb 100.

More specifically, second hair-dividing elements 21 are provided on both sides of each of the second teeth 20. The second hair-dividing elements 21 are directed to/face the first parts 10*a* and second parts 10*b* of the first teeth 10 of the first comb body 1 and more specifically the first hair-dividing elements 11. The second hair-dividing elements 21 on the sides of each of the second teeth 20 are preferably arranged symmetrically with respect to a plane comprising the longitudinal axis 200 of the cutting comb 100 and the longitudinal axis 203 of the second teeth 20 (a plane parallel to the XY-plane).

As depicted in FIGS. 4 and 6, the second hair-dividing elements 21 are advantageously equally distanced from each other in the direction of the longitudinal axis of the second teeth 20.

Between neighbouring second hair-dividing teeth 21, second channels 22 are formed. Due to the equal distance between all neighbouring second hair-dividing teeth 21, the second channels 22 are also identical to each other.

Similar to the first hair-dividing elements 11, the second hair-dividing elements 21 are also formed as projections (second projections). The second projections are more specifically formed as ribs or ridges. Each of the second projections extends vertically from the corresponding second tooth 20.

In addition, the second hair-dividing elements 21 extend over a whole length of the corresponding second tooth 20.

Moreover, the second hair-dividing elements 21 each comprise at least one curved portion 16 (FIG. 6). This construction contributes to a better guiding of the hair.

As can be understood from FIGS. 7 and 8, the first hair-dividing elements 11 and the second hair-dividing elements 21 are arranged with an offset to each other in a direction in which the first teeth 10 and the second teeth 20 extend, i.e. in the direction of the longitudinal axis 202 of the first teeth 10 and of the longitudinal axis 203 of the second teeth 20.

Furthermore, the first hair-dividing elements 11 and the second hair-dividing elements 21 are arranged such that they overlap with each other in a direction in which the first hair-dividing elements 11 and the second hair-dividing elements 21 extend (parallel to the Z-axis of the coordinate system 201).

Thus, the first channels 12 and the second channels 22 overlap with each other, so that sub-channels are formed between neighbouring first hair-dividing elements 11 and second hair-dividing elements 12.

To carry out the trimming of the hairs, the cutting comb 100 comprises a plurality of cutting means 3. The cutting means 3 are operated by an electric motor 4, as shown in FIG. 8. The electric motor 4 is positioned in the inner space 103 of the first comb body 1, and more specifically on a receiving portion of the second comb body 2. With regard to the position of the electric motor 4 in the cutting comb 100 as a whole, the electric motor 4 is arranged in the handle 102 of the cutting comb 100.

More specifically, a shaft 6 is provided between the electric motor 4 and the cutting means 3, so that the cutting means 3 are operable by the shaft 6 which are in turn driveable by the electric motor 4.

Each of the cutting means 3 is provided on a second tooth 20 of the second comb body 2.

More specifically, all second teeth 20 except for one second tooth 20 each comprise one cutting means 3. In other words, the cutting comb 100 has one less cutting means 3 than second teeth 20.

In the present embodiment, the tooth out of the second teeth 20, on which no cutting means is provided, is the one being closest to the handle 102 in a direction parallel to the longitudinal axis 200 of the cutting comb 100. This second tooth 20 comprises only a plurality of second hair-dividing elements 21.

On the other hand, the tooth out of the second teeth 20 that is in a position being farthest away from the handle 102 of the cutting comb 100 in a direction parallel to the longitudinal axis 200 of the cutting comb 100 is provided with cutting means 3 but no second hair-dividing elements.

Each cutting means 3 of a second tooth 20 is provided on a side of the second tooth 20 facing a side of a neighbouring second tooth 20. As can be seen from FIGS. 4 and 5, each cutting means 3 extends over the whole length of the corresponding second tooth 20.

Moreover, each cutting means 3 is arranged on the same corresponding side of the corresponding second tooth 20.

Furthermore, each cutting means 3 comprises a plurality of cutting blades 30 or knifes. More particularly, the cutting blades 30 or knifes are arranged next to each other to form a row of cutting blades 30 or knifes. It is apparent from FIGS. 5 and 6, that each cutting means 3 comprises two rows of cutting blades 30 or knifes that are symmetrical with respect to a plane comprising the longitudinal axis 200 of the cutting comb 100 and the longitudinal axis 203 of the second teeth 10 (a plane parallel to the XY-plane). Due to this, the cutting comb 1 can be used from both left-handed and right-handed users without any further adjustment.

With reference to FIG. 4, it becomes apparent that an angle 31 between the cutting blades 30 and a plane containing the longitudinal axis 200 of the cutting comb 100 and the longitudinal axis 203 of the second teeth 20 is in the range between zero degrees (exclusively) and ninety degrees (exclusively).

In addition, the cutting means 3 can be configured such that the angle 31 is adjustable within the aforementioned angle range.

According to another advantageous aspect of the present invention, the first teeth 10 and the second teeth 20 are configured to be heatable. To this end, the first teeth 10 and the second teeth 20 can each be provided with a heating element.

The heat being produced by the heating elements is transferred to the hair, thereby shaping and softening the hair. This makes cutting of the hair tips easier.

To further enhance this effect, the cutting 3 means are configured to be heatable in addition to the second teeth 20.

To this end, a heating element can be provided for each cutting means 3 such that the cutting means 3 can be directly heated. By doing so, heat generated by the heating elements can be directly transferred to the hair tips via the cutting means 3.

As a further measurement to enhance the cutting efficiency of the hair tips, the first teeth 10 and the second teeth 20 are made out of a material, preferably a metal, that in combination with the hair does not cause static electricity in the hair. Thus, it can be avoided that the different hairs fly away in different directions, what in turn results in a faster cutting of the hair tips.

Referring back to FIGS. 4 and 6, a top surface 25 of each second tooth 20 facing a cutting means 3 is formed flat.

However, the second teeth 20 facing a cutting means 3 may each be provided with a hair-bending element 26 for bending the hair that is placeable between two neighbouring first teeth 10. The hair-bending elements 26 are shown in FIG. 6 by a broken line. The hair-bending elements 26 are preferably formed as projections projecting from the top surfaces 25 of the second teeth 20.

The hair-bending elements 26 preferably extend over 50%, more preferably over 70%, more preferably over 90%, even more preferably over 100%, of the second tooth, in the direction of the longitudinal axis of the second tooth.

The projections preferably have a cross-section in the form of a triangle. The cross-section is defined in a plane vertical to the longitudinal axis 203 of the second teeth 20.

Each of the projections preferably has a height 204 equal to ⅔ of a distance 205 between a lowest point of the cutting means 3 that the projection faces and the top surface 25 of the respective second tooth 20 from which the respective projection projects.

In order to improve the directionality and positioning of the hair with respect to the cutting means 3, the cutting comb 100 comprises means 5 being configured to create a pressure in the part of the inner space 103 of the first comb body 1, especially close to where the second teeth 20 are arranged, that is lower than the atmospheric pressure. Due to this, hair is sucked towards the cutting means 3. By doing so, the cutting of the hair is made easier and the efficiency of the cutting comb 100 is improved further.

More specifically, the means 5 for creating the lower pressure than the atmospheric pressure comprises a fan that is preferably arranged on the axis of the electric motor 4. The rotation of the fan is such that it creates conditions of pressure in the inner space 103 of the first comb body 1 being lower than the atmospheric pressure, so that the hairs are sucked towards the cutting means 3.

To this end, the second teeth 20 comprising a cutting means 3 are formed to be hollow. As can be seen from FIG. 6, each of the second teeth 20 comprising a cutting means 3 comprises two openings 24, through which an inner space of each second tooth 20 communicates with the environment (atmosphere). The number of the openings 24 can however vary. The two openings 24 of a respective second tooth 20 are arranged each on one side of the cutting means 3 of the respective second tooth 20.

Further, with reference to FIG. 8, the shaft 6 is designed to be hollow and to comprise a plurality of openings 60, through which the inner space of the shaft 6 communicates with the inner spaces of the hollow second teeth 20. The inner space of the shaft 6 also communicates with the inner space 103 of the first comb body 1.

Thus, the inner spaces of the hollow second teeth 20 communicate with the means 5 for creating a sub-atmospheric pressure in the inner space 103 of the first comb body 1, so that air of the inner spaces of the hollow second teeth 20 can be drawn/sucked into the inner space 103 of the first comb body 1.

The air being drawn through into the inner space 103 of the first comb body 1 by the means 5 for creating a sub-atmospheric pressure in the inner space 103 can exit to the environment through an opening 18 of the first comb body 1 (FIG. 8).

The opening 18 is preferably formed close to the electric motor 4, so that the streaming air can effect a cooling of the electric motor 4.

In the following, the use of the cutting comb 100 will be explained based on FIGS. 7 and 8.

FIG. 7 shows the cutting comb 100 in a first operational state. More concretely, FIG. 7 is a cross-sectional view of the cutting comb 100 in order to enable a better overview of the relative position of its elements to each other in the first operational state. FIG. 8 shows the cutting comb 100 in a second operational state. For a better overview, the first part 13 of the first comb body 1 has been removed in FIG. 8.

In order to use the cutting comb 100, a user holding it by its handle 103 will enter the cutting comb 100 into the hair of person (or its hair). At this stage, the cutting comb 100 must be in the first operational state. In this state, the first teeth 10 and the second teeth 20 are aligned with each other. This means that each first tooth 10 is matched to a second tooth 20. For example, the closest first tooth 10 to the handle 102 is matched to the closest second tooth 20 to the handle 102, and the farthest first tooth 10 from the handle 102 is matched to the farthest second tooth 20 from the handle 102.

In this position, hair will have entered the spaces between neighbouring first teeth 10 and between neighbouring second teeth 20.

After that, the user will push the push handle 23 upwards in the direction of the longitudinal axis 200 of the cutting comb 100 in order to effect a movement of the second comb body 2 relative to the first comb body 1 and thus bring the cutting comb 100 into the second operational state (FIGS. 8 and 9).

In this state, each second tooth 20 will have moved by one first tooth 10. In other words, not all first teeth 10 are matched to a second tooth 20 in this state. More specifically, the first tooth 10 that is closest to the handle 102 is not aligned with a second tooth 20. In this state, the first tooth 10 closest to the handle 102 has an offset from the second tooth 20 closest to the handle 102. This offset equals to the distance between neighbouring first teeth 10 or the distance between neighbouring second teeth 20.

Due to the movement of the second comb body 2 with respect to the first comb body 1, hair 500 that has entered a space between two neighbouring first teeth 10 and two neighbouring second teeth 10, when the cutting comb 100 is in the first operational state, is now lifted by the corresponding second tooth 20 up to the next first tooth 10 in the second operational state. By this, hair 500 gets bent, as can be seen in FIG. 9. It is noted that, for the sake of a better understanding of the cutting operation of the cutting comb 100, a simplified cross-sectional view of only a part of the cutting comb 100 is shown in FIG. 9, in which some elements/features of the cutting comb 100 have been omitted.

At the same time with bending the hair 500 due to the movement of the second comb body 2 relative to the first comb body 1, hair 500 is divided into hair strands due to the second hair-dividing means 21 and the first hair-dividing means 11.

Thus, when the user moves the cutting comb 100 through the hair 500 by combing the hair 500, the hair strands formed by the second hair-dividing means 21 and the first hair-dividing means 11 are moved through the spaces between neighbouring first teeth 10 in a way that their tips 501 are trimmed by the cutting means 3, when the latter are activated. Consequently, any split ends of the hair 500, which occur at the hair tips 501, will be cut off.

For activating the cutting means 3, the electric motor 4 is first activated, e.g. by pressing a button or operating a switch.

The cutting comb 100 as described above has a simple structure and provides for an efficient trimming of the hair of a person.

The depicted and described features and further properties of the invention's embodiments can arbitrarily be isolated and recombined without leaving the gist of the present invention.

In addition to the foregoing description of the present invention, for an additional disclosure explicit reference is taken to graphic representation of FIGS. 1 to 8.

LIST OF REFERENCE SIGNS

1 first comb body
2 second comb body
3 cutting means
4 motor
5 means for causing a pressure in an inner space of the cutting comb lower than the atmospheric pressure/fan
6 shaft/rod
10 first tooth
10*a* first part of first tooth
10*b* first part of second tooth
11 first hair-dividing element (first hair-guiding element)
12 first channel
13 first part of first comb body
14 second part of first comb body
15 curved/rounded portion
16 curved/rounded portion
17 first base body
20 second tooth
21 second hair-dividing element (second hair-guiding element)
22 second channel
23 push handle
24 opening
25 top surface
26 hair-bending element
27 second base body
30 blade/knife
31 angle
60 opening
100 cutting comb
101 head
102 handle
103 inner space of first comb body
200 longitudinal axis of the cutting comb
201 coordinate system
202 longitudinal axis of the first teeth
203 longitudinal axis of the second teeth
204 height
205 distance
500 hair
501 hair tips

The invention claimed is:

1. A cutting comb configured to cut hair, comprising:

a first comb body having a plurality of first teeth, each of the plurality of first teeth oriented perpendicularly to a longitudinal axis of the cutting comb, a number of the plurality of first teeth having a plurality of first planar hair-dividing elements, the plurality of first planar hair-dividing elements extending substantially perpendicularly to a longitudinal axis of the first teeth and arranged parallel to one another on each respective first tooth, a second comb body with a plurality of second teeth oriented perpendicularly to the longitudinal axis of the cutting comb, a number of the second teeth having, on an upper portion thereof, a plurality of second planar hair-dividing elements separated by respective channels, the plurality of second planar hair-dividing elements extending perpendicularly to a longitudinal axis of the second teeth and arranged parallel to one another on each respective second tooth, some of the plurality of second planar hair-dividing elements being located on a first side of the respective tooth on which they are located and others of the plurality of second planar hair-dividing elements being located on a second, opposite, side of the respective tooth on which they are located, at least two rows of cutters, each located on a lower portion of one or more of the plurality of second teeth, wherein the first comb body and the second comb body are arranged to be movable relative to each other in a direction parallel to the longitudinal axis of the cutting comb, and wherein the plurality of first planar hair-dividing elements are configured to cooperate with the plurality of second planar hair-dividing elements to separate the hair into bundles to facilitate cutting of portions of the hair by the at least two rows of cutters.

2. The cutting comb according to claim 1, wherein one or more of: the plurality of planar first hair-dividing elements are formed as a first respective projections and the plurality of second planar hair-dividing elements are formed as second respective projections.

3. The cutting comb according to claim 2, wherein one or more of: the first respective projections extend perpendicularly from at least one first tooth and the second respective projections extend perpendicularly from at least one second tooth.

4. The cutting comb according to claim 1, wherein one or more of: the plurality of first planar hair-dividing elements and the plurality of second planar hair-dividing elements have at least one curved portion.

5. The cutting comb according to claim 1, wherein one or more of: the at least one first tooth and the at least one second tooth are heatable by a heating element.

6. The cutting comb according to claim 1, wherein one or more of: the at least one first tooth and the at least one second tooth are made out of a material that in combination with the hair does not cause static electricity in the hair.

7. The cutting comb according to claim 1, wherein the at least one second tooth comprises the cutters, the cutters each comprising at least one cutting blade, wherein an angle between the cutting blade and the longitudinal axis of the cutting comb is lower than 90 degrees or equal to 45 degrees.

8. The cutting comb according to claim 1, wherein the at least one second tooth comprises the cutters, the cutters each comprising at least one cutting blade, wherein the cutting blade is arranged such that that an angle between the cutting blade and the longitudinal axis of the cutting comb is adjustable.

9. The cutting comb according to claim 1, wherein the cutters are heatable by a heating element.

10. The cutting comb according to claim 1, further comprising a vacuum configured to create a pressure in an inner space of the first comb body that is lower than the atmospheric pressure, so that hair is sucked towards the cutter.

11. The cutting comb according to claim 10, wherein the vacuum is a fan.

12. A hair cutting comb comprising:

a first comb body with at least two first teeth, the at least two first teeth oriented perpendicularly to a longitudinal axis of the cutting comb, a second comb body with at least one second tooth, the at least one second tooth oriented perpendicularly to the longitudinal axis of the cutting comb, and a set of cutters located on a lower portion of the at least one second tooth configured to cut split ends of hair, wherein:

the first comb body and the second comb body are movable relative to each other in a direction parallel to the longitudinal axis of the cutting comb, and at least one first tooth of the first comb body comprises at least one planar first hair-dividing element configured to divide hair into hair strands, the at least one first planar hair-dividing element being immovably fixed to the at least one first tooth, wherein the at least one first planar hair-dividing element and at least one second planar hair-dividing element are arranged with an offset to each other in a direction in which the at least two first teeth and the at least one second tooth extend, and the at least one first planar hair-dividing element and the at least one second planar hair-dividing element project perpendicularly to a longitudinal axis of the teeth, at least two first planar hair-dividing elements, which form a first channel therebetween, and at least two second planar hair-dividing elements, which form a second channel therebetween, are configured so that hair is guided through one or more of the first channel and the second channel, wherein the first channel and the second channel extend in a direction along the longitudinal axis of the cutting comb, and all but one first tooth comprise the respective at least two first planar hair-dividing elements and all but one second tooth each comprise the respective at least two second planar hair-dividing elements.

13. The comb of claim 12, wherein the at least one second tooth of the second comb body comprises the at least one second hair-dividing element configured to divide hair into hair strands, the at least one second hair-dividing element being immovably fixed to the at least second tooth.

14. The cutting comb according to claim 12, wherein one or more of the at least one first hair-dividing element is formed as a first projection and the at least one second hair-dividing element is formed as a second projection.

15. The cutting comb according to claim 14, wherein one or more of the first projection extends perpendicularly from the at least one first tooth and the second projection extends perpendicularly from the at least one second tooth.

16. A cutting comb configured to cut split ends of hair comprising:

a first comb body having a plurality of first teeth, each of the plurality of first teeth oriented perpendicularly to a longitudinal axis of the cutting comb and parallel to one another, a number of the plurality of first teeth having a plurality of first planar hair-dividing elements separated by respective channels, the plurality of first planar hair-dividing elements extending substantially perpendicularly to a longitudinal axis of the first teeth and arranged parallel to one another on each respective first tooth, a second comb body with a plurality of second teeth oriented perpendicularly to the longitudinal axis of the cutting comb and parallel to one another, a number of the second teeth having, on an upper portion thereof, a plurality of second planar hair-dividing elements separated by respective channels, the plurality of second planar hair-dividing elements extending perpendicularly to a longitudinal axis of the second teeth and arranged parallel to one another on each respective second tooth, some of the plurality of second planar hair-dividing elements being located on a first side of the respective tooth on which they are located and others of the plurality of second planar hair-dividing elements being located on a second, opposite, side of the respective tooth on which they are located, at least two rows of cutters, each located on a lower portion of one or more of the plurality of second teeth, wherein the first comb body and the second comb body are arranged to be movable relative to each other in a direction parallel to the longitudinal axis of the cutting comb, and wherein the plurality of first planar hair-dividing elements are configured to cooperate with the plurality of second planar hair-dividing elements to separate the hair into bundles to facilitate the cutting of the split ends of the hair by the at least two rows of cutters.

* * * * *